US010872715B1

(12) United States Patent
Jolley

(10) Patent No.: US 10,872,715 B1
(45) Date of Patent: Dec. 22, 2020

(54) MAGNET WIRE WITH INSULATION INCLUDING AN ORGANOMETALLIC COMPOUND

(71) Applicant: Essex Group, Inc., Atlanta, GA (US)

(72) Inventor: Scott Ted Jolley, Fort Wayne, IN (US)

(73) Assignee: ESSEX FURUKAWA MAGNET WIRE USA LLC, Atlanta, GA (US)

( * ) Notice: Subject to any disclaimer, the term of this patent is extended or adjusted under 35 U.S.C. 154(b) by 0 days.

(21) Appl. No.: 16/449,744

(22) Filed: Jun. 24, 2019

(51) Int. Cl.

| | |
|---|---|
| ***H01B 17/62*** | (2006.01) |
| ***H01B 3/10*** | (2006.01) |
| ***H01B 3/30*** | (2006.01) |
| ***H01B 3/02*** | (2006.01) |
| ***H01B 7/02*** | (2006.01) |

(52) U.S. Cl.
CPC ..... *H01B 17/62* (2013.01); *H01B 3/025* (2013.01); *H01B 3/105* (2013.01); *H01B 3/306* (2013.01); *H01B 7/0275* (2013.01)

(58) Field of Classification Search
CPC ..... H02K 3/30; H01B 3/306; H01B 3/105; H01B 3/025; H01B 7/0275
See application file for complete search history.

(56) References Cited

U.S. PATENT DOCUMENTS

| | | | | |
|---|---|---|---|---|
| 3,577,346 | A * | 5/1971 | McKeown | C08K 5/57 174/110 SR |
| 4,760,296 | A * | 7/1988 | Johnston | C08K 3/36 174/127 |
| 5,306,739 | A * | 4/1994 | Lucey | C08F 290/08 424/441 |
| 2014/0162917 | A1* | 6/2014 | Komiyama | C10M 103/06 508/175 |
| 2016/0307663 | A1* | 10/2016 | Ikeda | H01F 27/32 |

OTHER PUBLICATIONS

Notification of Transmittal of the International Search Report and the Written Opinion of the International Searching Authority, or the Declaration for PCT/US2020/036940, dated Jul. 23, 2020.

* cited by examiner

*Primary Examiner* — Timothy J Thompson
*Assistant Examiner* — Amol H Patel

(57) ABSTRACT

Magnet wire with corona resistant enamel insulation is described. A magnet wire may include a conductor, and at least one layer of polymeric enamel insulation may be formed around the conductor. The polymeric enamel insulation may include a filler dispersed in a base polymeric material, such as polyimide. Additionally, the filler may include an organometallic compound.

18 Claims, 2 Drawing Sheets

MAGNET WIRE WITH INSULATION INCLUDING AN ORGANOMETALLIC COMPOUND

TECHNICAL FIELD

Embodiments of the disclosure relate generally to magnet wire and, more particularly, to magnet wire that includes insulation formed from polymeric enamel that includes an organometallic filler.

BACKGROUND

Magnet wire, also referred to as winding wire or magnetic winding wire, is utilized in a wide variety of electric machines and devices, such as inverter drive motors, motor starter generators, transformers, etc. Magnet wire typically includes polymeric enamel insulation formed around a central conductor. The enamel insulation is formed by applying a varnish onto the magnet wire and curing the varnish in an oven to remove solvents, thereby forming a thin enamel layer. This process is repeated until a desired enamel build or thickness has been attained. Polymeric materials utilized to form enamel layers are intended for use under certain maximum operating temperatures. Additionally, electrical devices may be subject to relatively high voltage conditions that may break down or degrade the wire insulation. For example, an inverter may generate variable frequencies that are input into certain types of motors, and the variable frequencies may exhibit steep wave shapes that cause premature motor winding failures.

Attempts have been made to reduce premature failures as a result of degradation of the wire insulation. These attempts have included minimizing damage to the wire and insulation during handling and manufacture of electric machines and devices, and using shorter lead lengths where appropriate. Further, a reactor coil or a filter between an inverter drive and a motor can extend the life of the windings by reducing the voltage spikes and high frequencies generated by the inverter drive/motor combination. However, such coils are expensive and add to the overall cost of the system. Increasing the amount of insulation can improve the life of the windings in an electrical device, but this option is both expensive and decreases the amount of space for the copper in the device, thereby producing a less efficient motor. Additionally, inter layer delamination may occur once a certain number of enamel layers has been reached. Therefore, there is an opportunity for improved magnet wire with insulation designed to withstand higher temperatures and/or voltages present within electrical devices for longer periods of time.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1A:
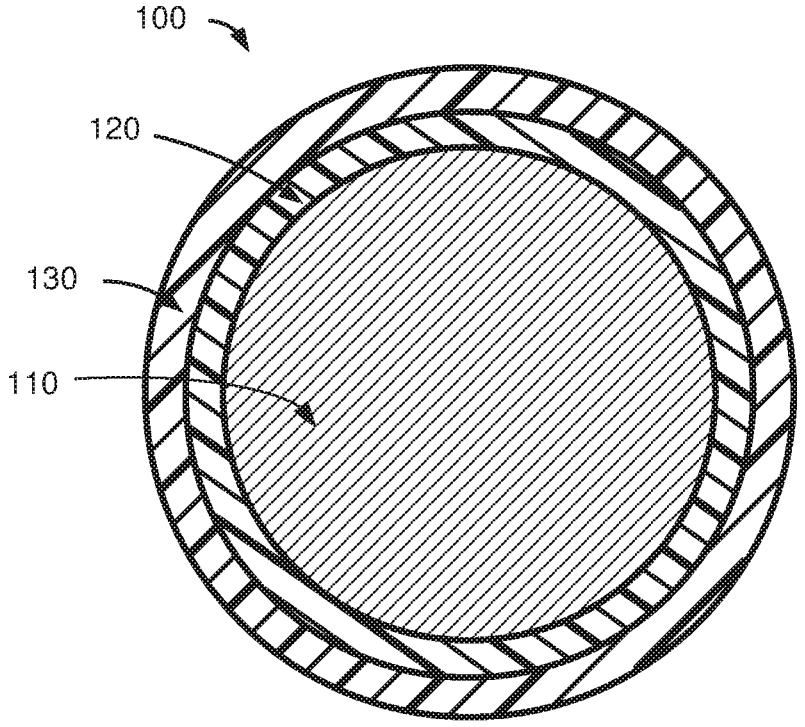
FIGS. 1A-2B illustrate cross-sectional views of example magnet wire constructions that may be formed in accordance with various embodiments of the disclosure.

Certain embodiments of the present disclosure are directed to magnet wire that includes polymeric enamel insulation having improved corona resistance relative to conventional magnet wire. Other embodiments of the disclosure are directed to methods of making magnet wire that includes polymeric enamel insulation having improved corona resistance. A wide variety of suitable polymeric materials may be utilized as desired to form enamel insulation. For example, in certain embodiments, the polymeric enamel insulation may include polyimide. According to an aspect of the disclosure, filler material may be added to a base polymeric material or resin prior to forming the polymeric enamel insulation. Additionally, the filler material may include one or more organometallic compounds. The addition of the filler may improve the corona resistance of one or more polymeric enamel layers formed from filled polymeric enamel on a magnet wire. As a result, the life of the magnet wire and/or an electrical device (e.g., motor, etc.) incorporating the magnet wire may be increased or extended under partial discharge and/or other adverse conditions.

A wide variety of suitable organometallic compounds or materials may be utilized as fillers in various embodiments. Additionally, in certain embodiments, an organometallic compound may be a fully soluble compound. In other words, when an organometallic compound is combined with a polymeric base material that is mixed or suspended in solvent, the organometallic compound will be fully dissolved or liquefied. In certain embodiments, an organometallic compound may include an amine salt of a metal oxide acid. For example, an organometallic compound may include an amine salt of molybdic acid, tungstic acid, or chromic acid. In other embodiments, an organometallic compound may include carbamate, thiocarbamate, or thiophosphate. Other suitable organometallic compounds may be utilized.

Additionally, in certain embodiments, a single type of organometallic compound or material may be utilized as a filler. In other embodiments, a combination of two or more different organometallic compounds may be utilized as a filler. In the event that two or more organometallic compounds are utilized, a wide variety of suitable blending or mixing ratios may be utilized for the various component compounds. For example, two or more component compounds may be blended at a wide variety of suitable ratios by weight.

Filler material may be also added to a base polymeric material at any suitable ratio. For example, in certain embodiments, a total amount of filler in a filled polymeric enamel insulation layer may be between approximately one percent (1.0%) and approximately ten percent (10%) by weight. In other embodiments, a total amount of filler may be between approximately three percent (3.0%) and approximately five percent (5.0%) by weight. In various other embodiments, a total amount of filler may be approximately 1, 2, 3, 4, 5, 6, 7, 7.5, 8, 9, or 10 percent by weight, an amount included in a range between any two of the above values, or an amount included in a range bounded on either a minimum or maximum end by one of the above values.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now to the drawings, FIG. 1A shows a cross-sectional end-view of an example round magnet wire 100, which may include a conductor 110 coated with enamel insulation. Any suitable number of enamel layers may be utilized as desired. As shown, a plurality of layers of enamel insulation, such as a base coat 120 and a topcoat 130, may be formed around the conductor 110. In other embodiments, a single layer of enamel insulation may be utilized. In yet other embodiments, more than two layers of enamel insulation may be utilized. Further, one or more of the enamel layers may include a suitable filler, and the filler may include at least one organometallic compound or material.

Figure 1B:
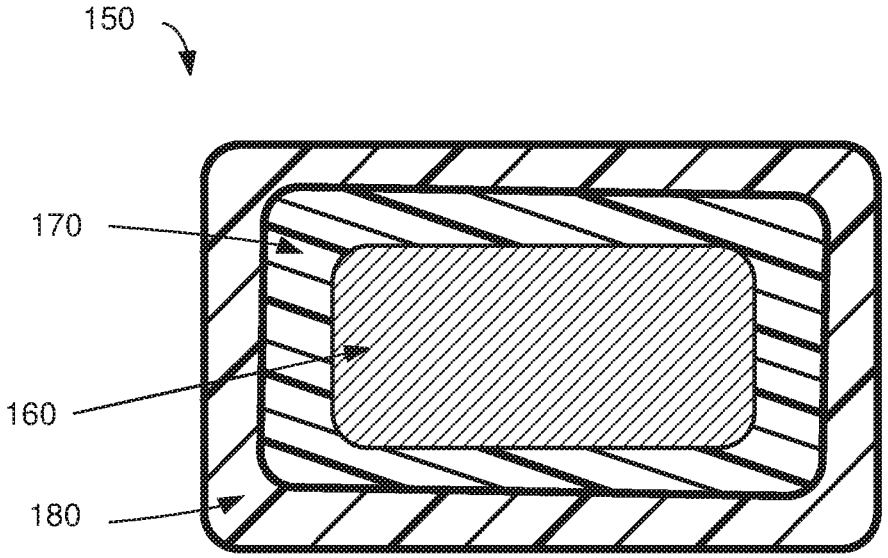

Similarly, FIG. 1B shows a cross-sectional end-view of an example rectangular magnet wire 150, which may include a conductor 160 coated with enamel insulation. Any suitable number of enamel layers may be utilized as desired. As shown, a plurality of layers of enamel insulation, such as a base coat 170 and a topcoat 180, may be formed around the conductor 160. In other embodiments, a single layer of enamel insulation may be utilized. In yet other embodiments, more than two layers of enamel insulation may be utilized. Further, one or more of the enamel layers may include a suitable filler, and the filler may include at least one organometallic compound or material. The round wire 100 of FIG. 1A is described in greater detail below; however, it will be appreciated that various components of the rectangular wire 150 of FIG. 1B may be similar to those described for the round wire 100 of FIG. 1A.

The conductor 110 may be formed from a wide variety of suitable materials or combinations of materials. For example, the conductor 110 may be formed from copper, aluminum, annealed copper, oxygen-free copper, silver-plated copper, nickel plated copper, copper clad aluminum ("CCA"), silver, gold, a conductive alloy, a bimetal, or any other suitable electrically conductive material. Additionally, the conductor 110 may be formed with any suitable cross-sectional shape, such as the illustrated circular or round cross-sectional shape. In other embodiments, a conductor 110 may have a rectangular (as shown in FIG. 1B), square, elliptical, oval, or any other suitable cross-sectional shape. As desired for certain cross-sectional shapes such as a rectangular shape, a conductor may have corners that are rounded, sharp, smoothed, curved, angled, truncated, or otherwise formed. The conductor 110 may also be formed with any suitable dimensions, such as any suitable gauge, diameter, height, width, cross-sectional area, etc.

Any number of layers of enamel, such as the illustrated base coat 120 and topcoat 130, may be formed around the conductor 110. An enamel layer is typically formed by applying a polymeric varnish to the conductor 110 and then baking the conductor 110 in a suitable enameling oven or furnace. The polymeric varnish typically includes thermosetting polymeric material or resin suspended in one or more solvents. A thermosetting or thermoset polymer is a material that may be irreversibly cured from a soft solid or viscous liquid (e.g., a powder, etc.) to an insoluble or cross-linked resin. Thermosetting polymers typically cannot be melted for application via extrusion as the melting process will break down or degrade the polymer. Thus, thermosetting polymers are suspended in solvents to form a varnish that can be applied and cured to form enamel film layers. Following application of a varnish, solvent is removed as a result of baking or other suitable curing, thereby leaving a solid polymeric enamel layer. As desired, a plurality of layers of enamel may be applied to the conductor 110 in order to achieve a desired enamel thickness or build (e.g., a thickness of the enamel obtained by subtracting the thickness of the conductor and any underlying layers). Each enamel layer may be formed utilizing a similar process. In other words, a first enamel layer may be formed, for example, by applying a suitable varnish and passing the conductor through an enameling oven. A second enamel layer may subsequently be formed by applying a suitable varnish and passing the conductor through either the same enameling oven or a different enameling oven. Indeed, an enameling oven may be configured to facilitate multiple passes of a wire through the oven. As desired in various embodiments, other curing devices may be utilized in addition to or as an alternative to one or more enameling ovens. For example, one or more suitable infrared light, ultraviolet light, electron beam, and/or other curing systems may be utilized.

As desired, each layer of enamel, such as the base coat 120 and the topcoat 130, may be formed with any suitable number of sublayers. For example, the base coat 120 may include a single enamel layer or, alternatively, a plurality of enamel layers or sublayers that are formed until a desired build or thickness is achieved. Similarly, the topcoat 130 may include one or a plurality of sublayers. Each layer of enamel and/or a total enamel build may have any desired thickness, such as a thickness of approximately 0.0002, 0.0005, 0.007, 0.001, 0.002, 0.003, 0.004, 0.005, 0.006, 0.007, 0.008, 0.009, 0.010, 0.012, 0.015, 0.017, or 0.020 inches, a thickness included in a range between any two of the aforementioned values, and/or a thickness included in a range bounded on either a minimum or maximum end by one of the aforementioned values.

A wide variety of different types of polymeric materials may be utilized as desired to form an enamel layer. Examples of suitable thermosetting materials include, but are not limited to, polyimide, polyamideimide, amideimide, polyester, polyesterimide, polysulfone, polyphenylenesulfone, polysulfide, polyphenylenesulfide, polyetherimide, polyamide, polyketones, etc. In certain embodiments, at least one enamel layer may include polyimide ("PI"). As desired, a plurality of polyimide layers may be formed. For example, both the base coat 120 and the topcoat 130 may be formed as PI layers. In other embodiments, one or more PI layers may be combined with enamel layers formed from other types of material. For example, the base coat 120 may be formed from PI while the topcoat 130 includes another polymeric material or blend of polymeric materials. Additionally, according to an aspect of the disclosure and as explained in greater detail below, one or more enamel layers (e.g., a PI enamel layer, etc.) may include a suitable filler.

In certain embodiments, the base coat 120 may include one or more layers of filled enamel (e.g., filled PI enamel, etc.), and a topcoat 130 that includes unfilled enamel (e.g., polyamideimide enamel, unfilled PI enamel, etc.) may be formed over the base coat 120. In other embodiments, the topcoat 130 may be formed as a filled layer. As desired, any suitable build or thickness ratio between the base coat 120 and the topcoat 130 may be utilized. In certain embodiments, a thickness or build ratio between the base coat 120 and the topcoat 130 may be between approximately 95/5 and approximately 85/15. In other words, the thickness or build of the topcoat 130 may constitute between approximately 5.0 percent and approximately 15.0 percent of the overall thickness or build of the combined enamel insulation. In other embodiments, the topcoat 130 may constitute approximately 2, 3, 5, 7, 10, 12, 15, 20, or 25 percent of the overall thickness or build of the combined enamel insulation.

Although a separate base coat 120 and topcoat 130 are illustrated in FIG. 1A, in other embodiments, a wire may be formed without a topcoat 130. The enamel formed around the wire may include one or a plurality of layers of polymeric enamel material that all have a similar construction. For example, one or a plurality of filled enamel layers, such as filled PI layers, may be formed around a conductor 110. Indeed, due to the miscibility of an organometallic compound that is added as a filler to a polymeric base material, the use of a topcoat 130 is optional.

Figure 2A:
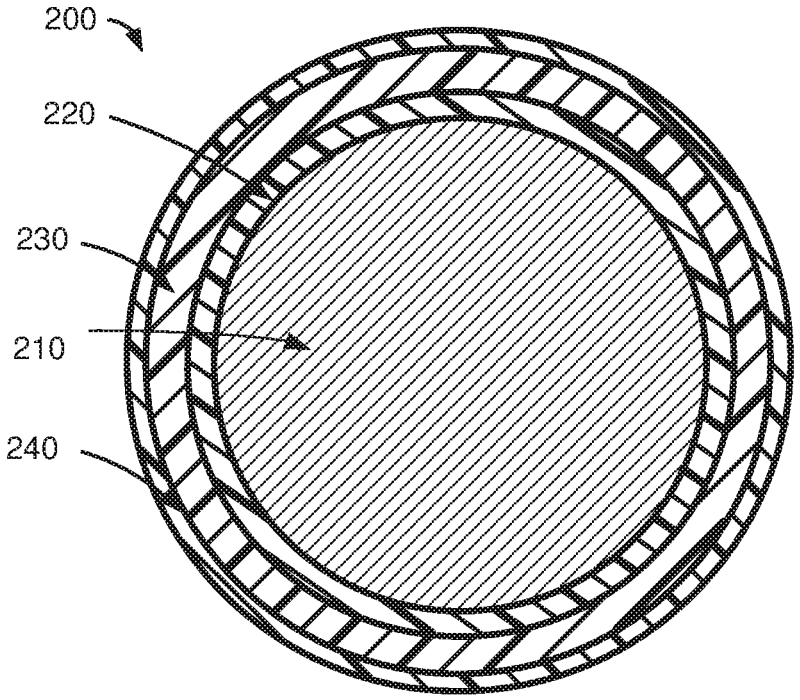
Figure 2B:
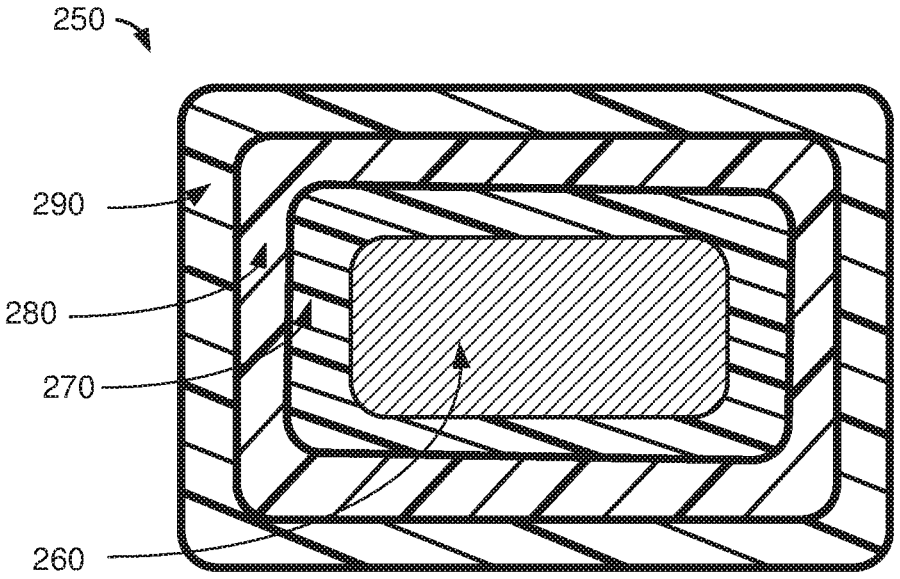

FIG. 2A shows a cross-sectional end-view of an example three-coat round magnet wire 200. The embodiment shown in FIG. 2A includes a conductor 210 surrounded by a polymeric base coat 220, a first polymeric layer 230 disposed on the base coat 220, and a second polymeric layer 240 disposed on the first polymeric layer 230. Similarly, FIG. 2B shows a cross-sectional end-view of an example three-coat rectangular magnet wire 250. The wire 250 includes a conductor 260 surrounded by a polymeric base coat 270, a first polymeric layer 280 disposed on the base coat 270, and a second polymeric layer 290 disposed on the first polymeric layer 280. The round wire 200 of FIG. 2A is described in greater detail below; however, it will be appreciated that various components of the rectangular wire 250 of FIG. 2B may be similar to those described for the round wire 200 of FIG. 2A.

With respect to the wire 200 of FIG. 2A, the conductor 210 may be similar to the conductor 110 described above with reference to FIG. 1A. Additionally, a wide variety of suitable polymers may be utilized to form the various layers of enamel 220, 230, 240. Examples of suitable thermosetting materials include, but are not limited to, polyimide, polyamideimide, amideimide, polyester, polyesterimide, polysulfone, polyphenylenesulfone, polysulfide, polyphenylenesulfide, polyetherimide, polyamide, polyketones, etc. In certain embodiments, at least one enamel layer may include polyimide ("PI"). Additionally, each of the base coat 220, first polymeric layer 230, and second polymeric layer 240 may include any desired number of sublayers. In certain embodiments, a plurality of PI layers may be formed. For example, all three layers 220, 230, 240 may be formed from PI.

In other embodiments, one or more PI layers may be combined with enamel layers formed from other types of material. For example, the base coat 220 may be formed from PAI or another polymeric material that promotes enhanced adhesion between the conductor 210 and the insulation formed around the conductor. The first polymeric layer 230 may then be formed from any suitable number of filled PI layers. The second polymeric layer 240 may then be formed as a topcoat over the filled PI layers. For example, the second polymeric layer 240 may be formed as an unfilled topcoat similar to the topcoat 130 discussed above with reference to FIG. 1A.

As another example, the base coat 220 and the first polymeric layer 230 may be formed as PI layers. For example, the base coat 220 may be formed form PI that promotes enhanced adhesion to the conductor 210. In certain embodiments, the base coat 220 may be formed from PI having a different formulation than PI used in the first polymeric layer 230. For example, the base coat 220 may include PI formed by reacting a dianhydride component (e.g., pyrometllitic dianhydride or PMDA) with a diamine component that contains 2,2-bis[4-(4-aminophenoxy)phenyl] propane ("BAPP"). The first polymeric layer 230 may include PI formed by reacting a dianhydride component with 4,4'-oxydianiline ("ODA"). The second polymeric layer 240 may then be formed as a topcoat over the filled PI layers. For example, the second polymeric layer 240 may be formed as a topcoat similar to the topcoat 130 discussed above with reference to FIG. 1A.

Indeed, a wide variety of suitable combinations of enamel may be formed as desired from any suitable materials and/or combinations of materials. Additionally, similar to the wire 100 of FIG. 1A, the wire 200 of FIG. 2A may include at least one layer that includes a suitable filler. In certain embodiments, one or more filled layers may be formed around the conductor 210 (e.g., directly around the conductor 210, around one or more base layers, etc.). As desired, one or more unfilled layers or self-lubricating layers, such as an unfilled topcoat (e.g., an unfilled second polymeric layer 240), may then be formed around the one or more filled PI layers. For example, an unfilled layer of PI or an unfilled layer of PAI may be formed over one or more filled PI layers. The unfilled layer(s) may assist in decreasing tooling wear associated with the abrasive materials utilized as fillers in the filled PI layers. In other embodiments, a topcoat may be formed as a filled layer.

With continued reference to the wires 100, 150, 200, 250 of FIGS. 1A-2B, in certain embodiments, one or more suitable adhesion promoters may be incorporated. For example, an adhesion promoter may be utilized to assist or facilitate greater adhesion between a conductor and a base coat. As another example, an adhesion promoter may be utilized to assist or facilitate greater adhesion between two different layers of enamel. A wide variety of suitable adhesion promoters may be utilized as desired. In other embodiments, one or more suitable surface modification treatments may be utilized on a conductor and/or any number of enamel layers to promote adhesion with a subsequently formed enamel layer. Examples of suitable surface modification treatments include, but are not limited to, a plasma treatment, an ultraviolet ("UV") treatment, a corona discharge treatment, and/or a gas flame treatment. A surface treatment may alter a topography of a conductor or enamel layer and/or form functional groups on the surface of the conductor or enamel layer that enhance or promote bonding of a subsequently formed enamel or other layer. In certain embodiments, the altered topography may also enhance or improve the wettability of a varnish utilized to form a subsequent enamel layer may altering a surface tension of the treated layer. As a result, surface treatments may reduce interlayer delamination.

As desired in certain embodiments, one or more other layers of insulation may be incorporated into a magnet wire 100, 150, 200, 250 in addition to a plurality of enamel layers. For example, one or more extruded thermoplastic layers (e.g., an extruded overcoat, etc.), semi-conductive layers, tape insulation layers (e.g., polymeric tapes, etc.), and/or conformal coatings (e.g., a parylene coating, etc.) may be incorporated into a magnet wire 100, 150, 200, 250. A wide variety of other insulation configurations and/or layer combinations may be utilized as desired. Additionally, an overall insulation system may include any number of suitable sublayers formed from any suitable materials and/or combinations of materials.

According to an aspect of the disclosure, one or more enamel layers (e.g., one or more PI layers, etc.) may include a suitable filler. For example, one or more PI enamel layers incorporated into a magnet wire, such as magnet wires 100, 150, 200, 250, may include a suitable filler. Additionally, the filler may include one or more organometallic compounds.

The addition of the filler may improve the corona resistance of one or more polymeric enamel layers formed from filled polymeric enamel on a magnet wire. As a result, the life of the magnet wire and/or an electrical device (e.g., motor, etc.) incorporating the magnet wire may be increased or extended under partial discharge and/or other adverse conditions.

A wide variety of suitable organometallic compounds or materials may be utilized as fillers in various embodiments. In certain embodiments, an organometallic compound may be a compound that contains at least one chemical bond between a carbon atom of an organic molecule and a metal. A wide variety of metals may be included in an organometallic compound, including alkaline, alkaline earth, transition metals, and metalloids. Additionally, in certain embodiments, an organometallic compound may be a fully soluble compound. In other words, when an organometallic compound is combined with a polymeric base material that is mixed or suspended in solvent, the organometallic compound will be fully dissolved or liquefied. In certain embodiments, the organometallic compound may be completely miscible within the polymeric base material and solvent such that a homogeneous solution is formed.

In certain embodiments, an organometallic compound may include an amine salt of a metal oxide acid. For example, an organometallic compound may include an amine salt of molybdic acid, tungstic acid, or chromic acid. An amine salt may be formed by combining an organic amine (e.g., $NH_2$, etc.) with a metal oxide acid. For example, an amine salt may be formed by combining an alkyl amine or an aromatic amine with a metal oxide acid. In other embodiments, an organometallic compound may include carbamate, thiocarbamate, and/or thiophosphate salts. In yet other embodiments, an organometallic compound may include a metallocene (e.g., ferrocene, zirconocene, etc.), a metal carboxylate (e.g., zinc oleate, cobalt 2-ethylhexanoate, etc.), and/or a metal alkoxide (e.g., titanium isopropoxide, tin alkoxide, etc.). Other suitable organometallic compounds and/or combinations of organometallic compounds may be utilized.

Filler material may be added to a base polymeric material at any suitable ratio. For example, in certain embodiments, a total amount of filler in a filled polymeric enamel insulation layer may be between approximately one percent (1.0%) and approximately ten percent (10%) by weight based on the dissolved polymer in the enamel. In other embodiments, a total amount of filler may be between approximately three percent (3.0%) and approximately five percent (5.0%) by weight. In various other embodiments, a total amount of filler may be approximately 1, 2, 3, 4, 5, 6, 7, 7.5, 8, 9, or 10 percent by weight, an amount included in a range between any two of the above values, or an amount included in a range bounded on either a minimum or maximum end by one of the above values.

Additionally, in certain embodiments, a single type of organometallic compound or material may be utilized as a filler. In other embodiments, a combination of two or more different organometallic compounds may be utilized as a filler. In the event that two or more organometallic compounds are utilized, a wide variety of suitable blending or mixing ratios may be utilized for the various component compounds. For example, two or more component compounds may be blended at a wide variety of suitable ratios by weight. In various embodiments, a ratio of a first component (e.g., a first organometallic compound) to a second component (e.g., a second organometallic compound) may be approximately 80/20, 75/25, 70/30, 67/33, 65/35, 60/40, 55/45, 50/50, 45/55, 40/60, 35/65, 33/67, 30/70, 25/75, 20/80, or any other suitable ratio.

Prior to being added to a base polymeric material, the components of a filler may exist in liquid form or as a soluble solid. Additionally, a wide variety of suitable methods and/or techniques may be utilized to add a filler to a base polymer. In certain embodiments, a filler may be blended into a polymeric varnish (e.g., a PI varnish) in the presence of solvent. In other embodiments, the filler may be optionally added into another substance (e.g., a PI paste, a paste formed from another polymeric material, etc.) and then added to a polymeric varnish. In other words, the filler may be added to an initial base material at a higher concentration and can be reduced in the final "letdown" of the end formulation.

Once a filler has been added to a polymeric material, the polymeric material may be applied to a conductor in any suitable manner. For example, the uncured polymeric insulation may be applied to magnet wire using multi-pass coating and wiping dies followed by curing at an elevated temperature (e.g., curing in an enameling oven). Any desired number of filled polymeric layers may be incorporated into or formed on a magnet wire. In various embodiments, these filled polymeric layers may be formed directly around a conductor or over one or more base layers. Further, in certain embodiments, one or more layers (e.g., a topcoat, an extruded layer, etc.) may be formed over the filled polymeric layer(s).

A magnet wire 100, 150, 200, 250 that includes one or more filled enamel layers may exhibit improved corona resistance relative to conventional magnet wire enamels. The organometallic compound(s) utilized as a filler may operate to distribute or spread corona discharge within a polymeric enamel layer. In other words, the organometallic compound(s) may reduce the likelihood that a corona discharge or a corona event will be concentrated at a particular point within a polymeric enamel layer. As a result, the addition of one or more organometallic compound(s) as a filler may improve the electrical performance of magnet wire insulation. For example, a partial discharge inception voltage ("PDIV") and/or other electrical performance parameters may be improved.

In certain embodiments, when a filled enamel layer is cured (e.g., cured in an enameling oven, etc.), cross-linking may occur between the polymeric material and the organometallic compound(s) utilized as a filler. This cross-linking may reduce the density of the filled polymeric enamel layer and increase free volume within the enamel layer. As a result, the dielectric constant of the polymeric enamel layer may be lowered as a result of incorporating one or more organometallic compounds. This lower dielectric constant may enhance or improve the PDIV and/or other electrical performance parameters of the polymeric enamel layer.

A magnet wire formed with insulation containing one or more enamel layers filled with organometallic material, such as one or more filled layers of PI, may exhibit improved PDIV performance relative to magnet wire including unfilled enamel insulation. In certain embodiments the addition of an organometallic filler to a base polymeric material (e.g., PI, etc.) may improve the PDIV performance of enamel insulation by at least approximately 5.0% relative to insulation formed from only the base polymeric material (e.g., unfilled PI, etc.). In other embodiments, the addition of an organometallic filler may improve PDIV performance by at least approximately 3.0%, 4.0%, 5.0%, 6.0%, 7.0%, 7.5%, 8.0%, 9.0%, 10.0%, 11.0%, 12.0%, 12.5%, 13.0%, 14.0%, or 15.0%, or by an amount included in a range between any two of the above values (e.g., by between approximately 5% and approximately 15%). It should be noted that conventional magnet wire enamel metallic fillers, such as silica oxide, titanium oxide, etc., may improve corona discharge parameters of the magnet wire insulation; however, these conventional fillers are not known to improve PDIV performance. Although the addition of organometallic fillers improves PDIV performance, the ultimate PDIV performance of a magnet wire may be dependent upon a wide variety of other factors, such as the type of base polymeric material(s) utilized and/or the insulation thickness. Thus, a magnet wire having insulation that includes one or more enamel layers filled with organometallic material may satisfy a wide variety of suitable PDIV parameters.

In certain embodiments, use of one or more filled enamel layers may provide a thermal class 240 magnet wire or higher. In various embodiments, the use of one or more filled enamel layers may provide a magnet wire having a thermal class of 240, a thermal class of 260, a thermal class of 280, or greater.

In certain embodiments, a single filled enamel layer may be formed around a conductor. The single filled enamel layer may include a filler formed from a single organometallic compound or from a suitable blend of two or more organometallic compounds. In other embodiments, a plurality of filled enamel layers may be formed around a conductor. In certain embodiments, each of the plurality of filled enamel layers may include a similar construction. For example each of the plurality of layers may include a filler formed from a single organometallic compound or a blend of two or more organometallic compounds. Additionally, filler may be added to each of the plurality of layers at a similar fill rate. In other embodiments, at least two filled enamel layers may be formed with different constructions. For example, two filled enamel layers may include different fill rates of a filler material (e.g., a first layer has an approximately 3.0 percent fill rate and a second layer has an approximately 5.0 percent fill rate, etc.). As another example, two filled enamel layers may utilize different organometallic filler materials and/or combinations of materials. As yet another example, two filled enamel layers may include different blend ratios of two or more organometallic materials. Indeed, a wide variety of suitable layer constructions may be formed as desired.

The magnet wires 100, 150, 200, 250 described above with reference to FIGS. 1A-2B are provided by way of example only. A wide variety of alternatives could be made to the illustrated magnet wires 100, 150, 200, 250 as desired in various embodiments. For example, a wide variety of different types of insulation layers may be incorporated into a magnet wire 100, 150, 200, 250 in addition to one or more enamel layers. As another example, the cross-sectional shape of a magnet wire 100, 150, 200, 250 and/or one or more insulation layers may be altered. Indeed, the present disclosure envisions a wide variety of suitable magnet wire constructions. These constructions may include insulation systems with any number of layers and/or sublayers.

Examples

The following examples are intended as illustrative and non-limiting, and represent specific embodiments of the present invention. Unless otherwise stated, the wire samples discussed in the examples were all prepared as rectangular wire with a "heavy" enamel build. In other words, the wire enamels were applied to rectangular copper wire using multi-pass coating and wiping dies. The "heavy" enamel build of the examples has a nominal insulation build of approximately 9.6 mils (0.245 mm) and is formed by applying 27 layers of enamel onto a wire. Additionally, organometallic fillers were added to polyimide in the examples at approximately 4% by weight of the formed polymeric enamel insulation.

A first example illustrated in Table 1 compares the effects of adding one or more organometallic compounds as filler materials to PI enamel.

TABLE 1

Comparative Filled PI Samples
PDIV Measurements for Enamels Filled with Organometallic Materials

| Sample | Film Build (mm) | Concentricity | PDIV (v, peak) |
|---|---|---|---|
| PI Enamel (No filler) | 0.247 | 1.2 | 1550 |
| Tungsten Amine Salt | 0.246 | 1.3 | 1692 |
| Molybdenium Amide Salt | 0.242 | 1.29 | 1663 |
| Antimony dithiocarbamate (2 inner layers) | 0.248 | 1.21 | 1614 |
| Antimony dithiocarbamate | 0.244 | 1.26 | 1737 |

As shown in Table 1, a wire with unfilled PI enamel was measured to have a peak PDIV of approximately 1550 volts. Each of the comparative filled examples exhibited improved PDIV performance. Three of the filled examples were formed with 27 successive layers of filled enamel formed around the conductor. The other example was formed with two inner layers of filled enamel formed around the conductor. An additional 25 layers of unfilled PI enamel was then formed over the two inner layers. Thus, the use of a few filled layers was shown to improve PDIV performance.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A magnet wire comprising:

a conductor; and at least one layer of polymeric enamel insulation formed around the conductor, the polymeric enamel insulation comprising a filler dispersed in a base polymeric material, wherein the filler comprises an organometallic compound formed from a transition metal, the organic compound comprising one of carbamate salt, thiocarbamate salt, thiophosphate salt, or an amine salt of a metal oxide acid, and wherein the filler comprises less than 5.0 percent by weight of the polymeric enamel insulation.

2. The magnet wire of claim 1, wherein the organometallic compound is a fully soluble compound.

3. The magnet wire of claim 1, wherein the organometallic compound comprises an amine salt of a metal oxide acid, and wherein the metal oxide acid comprises one of molybdic acid, tungstic acid, or chromic acid.

4. The magnet wire of claim 1, wherein the base polymeric material comprises one of polyimide or polyamide-imide.

5. The magnet wire of claim 1, wherein the at least one layer of polymeric enamel insulation comprises a plurality of layers of polymeric enamel insulation.

6. The magnet wire of claim 1, wherein the filled polymeric enamel insulation has a partial discharge inception voltage that is at least five percent greater than that of the base polymeric material.

7. A magnet wire comprising:

a conductor; and filled polymeric enamel insulation formed around the conductor, the filled polymeric enamel insulation comprising a base polymeric material and a fully soluble organometallic compound formed from a transition metal, wherein the filled polymeric enamel insulation has a partial discharge inception voltage that is at least five percent greater than that of the base polymeric material.

8. The magnet wire of claim 7, wherein the organometallic compound comprises an amine salt of a metal oxide acid.

9. The magnet wire of claim 8, wherein the metal oxide acid comprises one of molybdic acid, tungstic acid, or chromic acid.

10. The magnet wire of claim 7, wherein the organometallic compound comprises one of carbamate salt, thiocarbamate salt, or thiophosphate salt.

11. The magnet wire of claim 7, wherein the organometallic compound comprises less than 5.0 percent by weight of the polymeric enamel insulation.

12. The magnet wire of claim 7, wherein the base polymeric material comprises one of polyamideimide or polyimide.

13. The magnet wire of claim 7, wherein the filled polymeric enamel insulation comprises a first layer of insulation, and further comprising:

a second layer of insulation formed around the conductor.

14. A magnet wire comprising:

a conductor; and filled polymeric enamel insulation formed around the conductor, the filled polymeric enamel insulation comprising polyimide filled with a fully soluble organometallic compound comprising a transition metal, wherein the filled polymeric enamel insulation has a partial discharge inception voltage that is at least five percent greater than the polyimide.

15. The magnet wire of claim 14, wherein the organometallic compound comprises an amine salt of one of molybdic acid, tungstic acid, or chromic acid.

16. The magnet wire of claim 14, wherein the organometallic compound comprises less than five percent by weight of the filled polymeric enamel insulation.

17. The magnet wire of claim 14, wherein the organometallic compound comprises an amine salt of a metal oxide acid.

18. The magnet wire of claim 14, wherein the organometallic compound comprises one of carbamate salt, thiocarbamate salt, or thiophosphate salt.

* * * * *